US008616277B2

(12) United States Patent
Backhaus et al.

(10) Patent No.: US 8,616,277 B2
(45) Date of Patent: Dec. 31, 2013

(54) REAL TIME FORMATION PRESSURE TEST AND PRESSURE INTEGRITY TEST

(75) Inventors: Oliver Backhaus, Garbsen (DE); John D. Macpherson, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 438 days.

(21) Appl. No.: 12/102,117

(22) Filed: Apr. 14, 2008

(65) Prior Publication Data

US 2009/0255731 A1 Oct. 15, 2009

(51) Int. Cl.
*E21B 49/10* (2006.01)

(52) U.S. Cl.
USPC . 166/264; 166/100; 166/250.07; 166/250.08; 166/250.17

(58) Field of Classification Search
USPC ..... 166/250.07, 250.08, 250.17, 264, 100
See application file for complete search history.

(56) References Cited

U.S. PATENT DOCUMENTS

| | | | | |
|---|---|---|---|---|
| 5,337,234 | A * | 8/1994 | Anderson et al. | 702/6 |
| 5,622,223 | A * | 4/1997 | Vasquez | 166/264 |
| 5,812,068 | A * | 9/1998 | Wisler et al. | 340/855.5 |
| 6,315,041 | B1 | 11/2001 | Carlisle et al. | |
| 6,672,386 | B2 * | 1/2004 | Krueger et al. | 166/252.5 |
| 6,871,713 | B2 * | 3/2005 | Meister et al. | 175/50 |
| 6,913,093 | B2 * | 7/2005 | Hall et al. | 175/57 |
| 7,219,541 | B2 * | 5/2007 | DiFoggio | 73/152.17 |
| 7,231,819 | B2 * | 6/2007 | Jones et al. | 73/152.23 |
| 2004/0256113 | A1 | 12/2004 | LoGiudice et al. | |
| 2005/0200498 | A1 | 9/2005 | Gleitman | |
| 2006/0201671 | A1 | 9/2006 | Rogers et al. | |
| 2008/0060846 | A1 * | 3/2008 | Belcher et al. | 175/25 |
| 2009/0101340 | A1 * | 4/2009 | Jeffryes | 166/250.08 |

OTHER PUBLICATIONS

Rogers, et al. "Very High-Speed Drill String Communications Network: An Enabling Technology". Downhole Telementry. GasTIPS. Spring 2003. pp. 4-7.
Rogers, et al. "U.S. DOE R&D Efforts in Deep Gas Drilling Technology". AADE-03-NTCE-61. Apr. 1-3, 2003. pp. 1-12.
Completion Tools. Acoustic Telemetry System. Halliburton. www.halliburton.com. 2007.
Notification Concerning Transmittal of International Preliminary Report on Patentability and Written Opinon of the Interntional Searching Authority for International Application No. PCT/US2009/040472. Mailed Oct. 28, 2010.

* cited by examiner

*Primary Examiner* — Shane Bomar
*Assistant Examiner* — Robert E Fuller
(74) *Attorney, Agent, or Firm* — Cantor Colburn LLP

(57) ABSTRACT

A system for measuring a formation parameter, the system including: a formation parameter test device having: a structure capable of segregating a discrete volume including a formation interface surface within a well, and a parameter sensor in operable communication with the volume; a high bandwidth communications system in operable communication with the parameter sensor; and a processing unit in operable communication with the high bandwidth communications system and disposed remotely from the parameter sensor, the processing unit configured to receive parameter data.

21 Claims, 4 Drawing Sheets

REAL TIME FORMATION PRESSURE TEST AND PRESSURE INTEGRITY TEST

BACKGROUND OF THE INVENTION

1. Field of the Invention

This invention relates to testing geologic formations. More specifically, the invention relates to testing involving measuring a pressure of a formation and testing a sample of a formation fluid downhole.

2. Description of the Related Art

Exploration and production of hydrocarbons generally requires testing of geologic formations that may contain reservoirs of the hydrocarbons. Testing is performed to determine several parameters of the formation. One important parameter is formation pressure.

In a formation pressure test, a downhole tool extends a formation pressure test device to contact a wall of a borehole penetrating the formation. Pressure in the device is drawn down until formation fluid enters the device. The pressure at which the formation fluid enters the device is the formation pressure.

A low bandwidth communications system such as a pulsed-mud system is traditionally used to start the formation pressure test. In addition, the low bandwidth communication system is used to transmit a limited amount of data from the formation pressure test device to the surface of the earth for evaluation.

The time it takes for the data to be transmitted to the surface of the earth is generally greater than the time required for performing each step in the formation pressure test. Thus, once the test is started, then the test is brought to completion even if a problem develops during the test. Complications during the test can result in an improperly performed test producing poor quality data or no data at all. If a component of the formation pressure test device is damaged, then several complete cycles of testing may be performed before the component is identified as being damaged. Time lost performing inadequate tests in a borehole can be a waste of resources.

Therefore, what are needed are techniques for performing tests in a borehole and communicating test results to a remote location in a time short enough to enable control of the test during the test process.

BRIEF SUMMARY OF THE INVENTION

Disclosed is an embodiment of a system for measuring a formation parameter, the system including: a formation parameter test device having: a structure capable of segregating a discrete volume including a formation interface surface within a well, and a parameter sensor in operable communication with the volume; a high bandwidth communications system in operable communication with the parameter sensor; and a processing unit in operable communication with the high bandwidth communications system and disposed remotely from the parameter sensor, the processing unit configured to receive parameter data.

Also disclosed is an example of a method for measuring a formation parameter, the method including: isolating a discrete volume having a formation interface surface within a well from hydrostatic pressure; performing a measurement of the formation parameter with a parameter sensor in operable communication with the discrete volume; and transmitting in real time the measurement from the sensor to a processing unit disposed remotely from the sensor.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Figure 1:
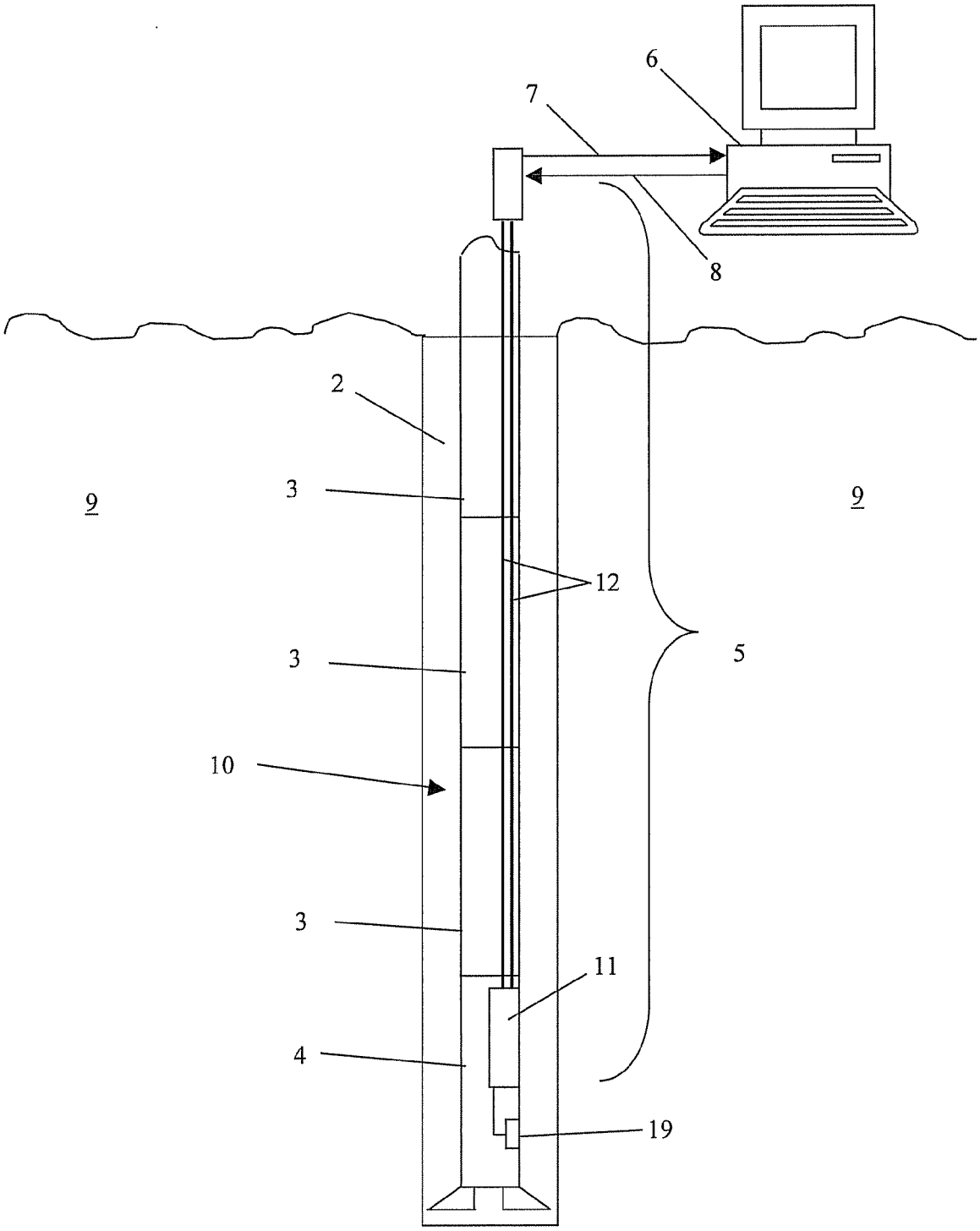
FIG. 1 is an exemplary embodiment of a drill string disposed in a borehole penetrating the earth.

Disclosed are exemplary techniques for measuring a formation parameter such as formation pressure in a borehole. In addition, a pressure of a static head above a pressure sensor can be measured as generally required during a pressure integrity or leakoff test. The techniques, which include systems and methods, use a formation parameter test device including a parameter sensor disposed at a drill string in the borehole. The parameter sensor measures pressure and transmits the measurement to a processing unit using a high bandwidth communications system. The high bandwidth communications system provides two-way (bidirectional) communications between the processing unit and the sensor and associated apparatus downhole. The speed of communications is high enough such that measurements (or data) from the parameter sensor are received in a short enough time period to be considered "real time." Similarly, control of testing performed downhole is also considered to be in real time.

For convenience, certain definitions are presented for use throughout the specification. The term "drill string" relates to at least one of drill pipe and a bottom hole assembly. In general, the drill string includes a combination of the drill pipe and the bottom hole assembly. The bottom hole assembly may be a drill bit, sampling apparatus, logging apparatus, or other apparatus for performing other functions downhole. As one example, the bottom hole assembly can be a drill collar containing measurement while drilling (MWD) apparatus. The term "real time" relates to a time period for communications between a processing unit generally disposed at the surface of the earth and downhole apparatus. The downhole apparatus can include sensors such as the pressure sensor and other devices used to perform a function downhole such as performing a leakoff test or a formation pressure test. The time period for real time communications is generally shorter than other time periods related to the function being communicated. For example, if a formation pressure test requires several steps, then real time communications for the test will transmit and receive data in a time period shorter than at least one time period of the steps. As used herein, generation of the data in "real-time" is taken to mean generation of the data at a rate that is useful or adequate for performing measurements or for providing control of testing downhole. Accordingly, it should be recognized that "real-time" is to be taken in context, and does not necessarily indicate the instantaneous determination of measurements or instantaneous control of testing, or make any other suggestions about the temporal frequency of data collection and determination.

The term "sensor" relates to any device used for measuring a parameter that is communicated to the processing unit in real time. Non-limiting examples of measurements performed by the sensors include pressure, temperature, optical property (such as refractive index or clarity), salinity, density, viscosity, conductivity, chemical composition, force and position. As these sensors are known in the art, they are not discussed in any detail herein. The term "processing unit" relates to a system for receiving measurements from at least one sensor disposed on a drill string. The processing unit can also send signals to the sensors or downhole apparatus for performing certain functions. In some embodiments, the processing unit can send an instruction to the downhole apparatus to perform a diagnostic check. In other embodiments, the downhole apparatus can send a status signal to the processing unit without the instruction. The term "status" relates to at least one of a condition and a diagnostic check of a downhole apparatus linked to the processing unit by the high bandwidth communications system. The term "static head" relates to a pressure exerted at a depth downhole due to the weight of a column of fluid above the depth. The term "operable communication" relates to communication between two elements. Two elements in operable communication may communicate using an intervening element.

Referring to FIG. 1, a simplified example of a drill string 10 is shown disposed in a borehole 2 penetrating the earth 9. The earth 9 can include a formation not shown. The drill string 10 includes drill pipe 3 and a bottom hole assembly (BHA) 4. The BHA 4 represents any tool (such as a test device or sensor) disposed on the drill string 10. A parameter sensor 19 is disposed on the drill string 10. In the embodiment of FIG. 1, the parameter sensor 19 measures pressure and is referred to as the pressure sensor 19. The pressure sensor 19 is linked by a high bandwidth communications system 5 to a processing unit 6 at a remote location such as at the surface of the earth 9. The processing unit 6 receives data 7 from the pressure sensor 19. The data 7 includes measurements of pressure. The data 7 can also include the status of the pressure sensor 19. In addition to receiving data 7, the processing unit 6 can also transmit commands 8 to the pressure sensor 19. The commands 8 can include, for example, commands for performing a measurement, sending a status, going into a "sleep mode."

Referring to the embodiment of FIG. 1, the high bandwidth communications system 5 includes a downhole electronics unit 11. The downhole electronics unit 11 is an interface between the high bandwidth communications system 5 and the pressure sensor 19. Interface functions include multiplexing the data 7 from the pressure sensor 19 and other downhole apparatus. Other embodiments of the high bandwidth communications system 5 may not include the downhole electronics unit 11 wherein the pressure sensor 19 transmits the data 7 directly to the processing unit 6.

In the embodiment of FIG. 1, the processing unit 6 is disposed at the surface of the earth 9 where the processing unit 6 can provide real time information to a user. However, in some embodiments, the processing unit 6 can be distributed among several processors either in the borehole 2 or at other locations remote to the pressure sensor 19. Further, the processing unit 6 may provide distributed processing or control by being distributed with the downhole apparatus or the sensor 19.

One example of the high bandwidth communications system 5 is "wired pipe." In one embodiment of wired pipe, the drill pipe 3 is modified to include a broadband cable protected by a reinforced steel casing. At the end of each drill pipe 3, there is an inductive coil, which contributes to communication between two drill pipes 3. In this embodiment, the broadband cable is used to transmit the data 7 to the processing unit 6. About every 500 meters, a signal amplifier is disposed in operable communication with the broadband cable to amplify the data 7 to account for signal loss. The processing unit 6 receives the data 7 from the broadband cable either directly or indirectly. Similarly, the processing unit 6 can transmit commands 8 to the downhole apparatus or the BHA 4 using the wired pipe. The high bandwidth communications system 5 depicted in FIG. 1 includes two conductors 12, affixed to the drill pipe 3, that are used to transmit at least one of the data 7 and the commands 8. The two conductors 12 can be used to form the broadband cable.

One example of wired pipe is INTELLIPIPE® commercially available from Intellipipe of Provo, Utah, a division of Grant Prideco. One example of the high bandwidth communications system 5 using wired pipe is the INTELLISERV® NETWORK also available from Grant Prideco. The Intelliserv Network has data transfer rates from fifty-seven thousand bits per second to one million bits per second. The high speed data transfer enables sampling rates of the measured parameters at up to 200 Hz or higher with each sample being transmitted to the surface of the earth 9.

Turning now to the processing unit 6, the processing unit 6 may include a computer processing system. Exemplary components of the computer processing system include, without limitation, at least one processor, storage, memory, input devices (such as a keyboard and mouse), output devices (such as a display) and the like. As these components are known to those skilled in the art, these are not depicted in any detail herein.

Generally, some of the teachings herein are reduced to an algorithm that is stored on machine-readable media. The algorithm is implemented by the computer processing system executing machine-executable instructions and provides operators with desired output.

Aspects of performing a pressure integrity test, also referred to as a leakoff test, using the techniques disclosed herein are discussed next. Information about the formation penetrated by the borehole 2 is determined by the leakoff test. The leakoff test determines a pressure at which fluid is forced into the formation. The leakoff test is generally conducted after drilling to a certain point. During the leakoff test, the well is isolated and fluid is pumped into the borehole 2 to gradually increase the pressure the formation experiences. At some pressure (the leakoff pressure), the fluid will enter the formation or "leakoff" from the borehole 2. The leakoff pressure is generally determined from a plot of volume of injected fluid versus fluid pressure. The use of the pressure sensor 19 linked to the processing unit 6 via the high bandwidth communications system 5 provides a large number of data points (i.e., pressure measurements) in real time. The large number of data points provides a smooth curve plot, which improves the accuracy of determining the leakoff pressure. In addition, obtaining the large number of data points in real time allows for comparing the data points against each other as a quality check. If the quality of the data points is suspect, then the test can be halted before anymore time is wasted, thus, saving resources.

Figure 2:
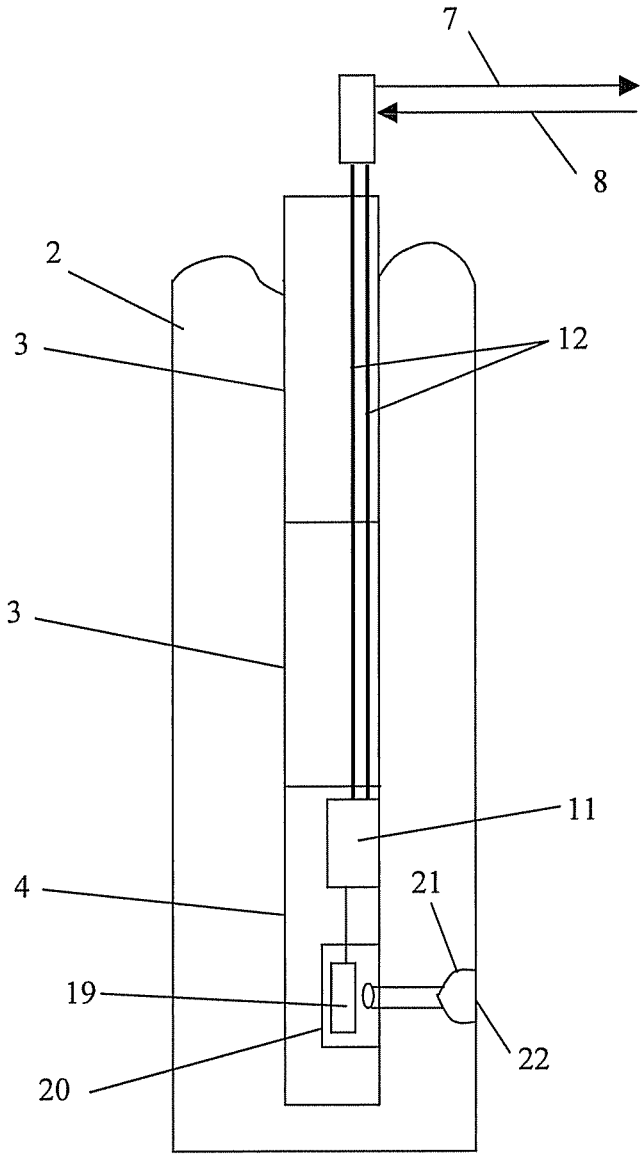
FIG. 2 depicts aspects of a formation pressure test device.

Aspects of performing a formation pressure test using the techniques disclosed herein are discussed next. The formation pressure test is used to determine the pressure of the fluid in the formation. FIG. 2 illustrates a simplified embodiment of a formation parameter test device 20 used for performing the formation parameter test. In the embodiment of FIG. 2, the formation parameter test device 20 is used to measure formation pressure and is referred to as the formation pressure test device (FPTD) 20. The FPTD 20 can be disposed on the drill string 10 for use during drilling operations. Referring to FIG. 2, the FPTD 20 includes a structure 21 with an opening 22. The structure 21 is capable of segregating a discrete volume within a well wherein a surface of the discrete volume is an interface with the formation. Because of hydrostatic pressure in the borehole 2, the structure 21 is used to isolate the discrete volume from the hydrostatic pressure. The perimeter of the opening 22 is adapted for sealing to the wall of the borehole 2. The structure 21 is extended from the FPTD 20 until the opening 22 contacts and seals with the wall of the borehole 2. In some embodiments, the structure 21 may resemble a "rubber plunger." Once the opening 22 is sealed with the wall, pressure in the structure 21 is reduced or drawn down until, generally, formation fluid flows into the discrete volume. The pressure sensor 19 measures the pressure in the discrete volume. In some embodiments, the pressure at which the formation fluid starts to flow into the discrete volume is referred to as the formation pressure.

As with the leakoff test discussed above, the use of the high bandwidth communications system 5 provides a high number of data points. Similarly, the high number of data points increases the accuracy of the formation pressure test. Another benefit of real time communications is that a problem with the FPTD 20 can be recognized before the formation pressure test is completed. The operator using the processing unit 6 can terminate the test by sending at least one command 8 to the FPTD 20 before wasting resources to complete the flawed test. Alternatively, the processing unit 6 can be programmed to terminate the test automatically upon determining a problem. The problem can be identified from the pressure measurements in the data 7 or upon receipt of a "trouble signal" from the FPTD 20.

The FPTD 20 is adapted for receiving the commands 8 from the processing unit 6. The commands 8 can include a start command, a stop command, a status check command, a "sleep" command, or any command associated with performing the formation pressure test. Real time communications with the high bandwidth communications system 5 results in the commands 8 being quickly executed and the data 7 being quickly provided to the operator.

As noted above, during the formation pressure test, formation fluid can enter the structure 21 of the FPTD 20. The FPTD 20 can be adapted to measure a parameter of the formation fluid that enters the structure 21. Alternatively, a sample test device similar to the FPTD 20 can be dedicated to performing a sample test of the formation fluid.

Figure 3:
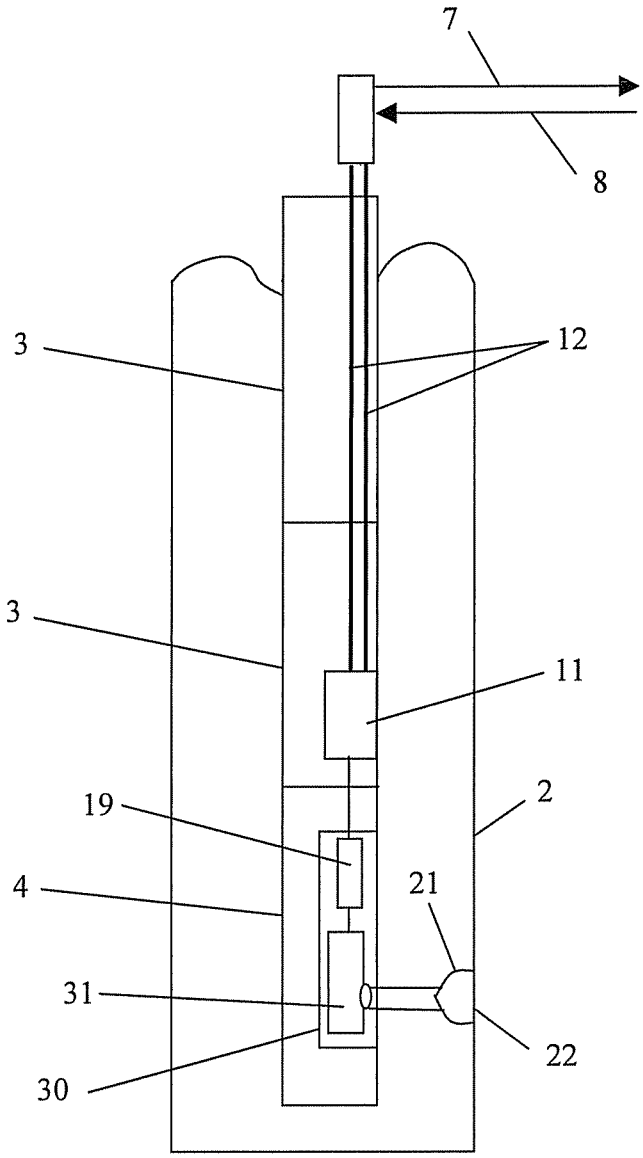
FIG. 3 depicts aspects of a sample test device.

FIG. 3 illustrates an exemplary embodiment of a sample test device (STD) 30. The STD 30 receives the formation fluid similar to the way the structure 21 receives the formation fluid; that is by decreasing pressure in the structure 21. In addition to the pressure sensor 19, the STD 30 includes a sample test sensor 31. The sample test sensor 31 can be any sensor for measuring or determining at least one of temperature, salinity, density, viscosity, conductivity, optical property, and chemical composition. When the sample test sensor 31 determines chemical composition, the sample test sensor 31 can be any of several spectrometers known in the art of chemical spectroscopy. Real time communication between components of the STD 30 and the processing unit 6 is provided by the high bandwidth communications system 5. As with the FPTD 20, the STD 30 is configured to receive the commands 8 (examples listed above) from the processing unit 6 and transmit the data 7 that includes measurements from the sample test sensor 31. Because the communications are in real time, the operator via the processing unit 6 can start a test, stop a test, alter a test, or change a test in response to the data 7. Alternatively, the processing unit 6 can be programmed to automatically transmit the commands 8 to perform these functions.

A high degree of quality control over the data 7 may be realized during implementation of the teachings herein. For example, quality control may be achieved through known techniques of iterative processing and data comparison. Accordingly, it is contemplated that additional correction factors and other aspects for real-time processing may be used. Advantageously, the operator may apply a desired quality control tolerance to the data 7, and thus draw a balance between rapidity of determination of the data 7 and a degree of quality in the data 7.

Figure 4:
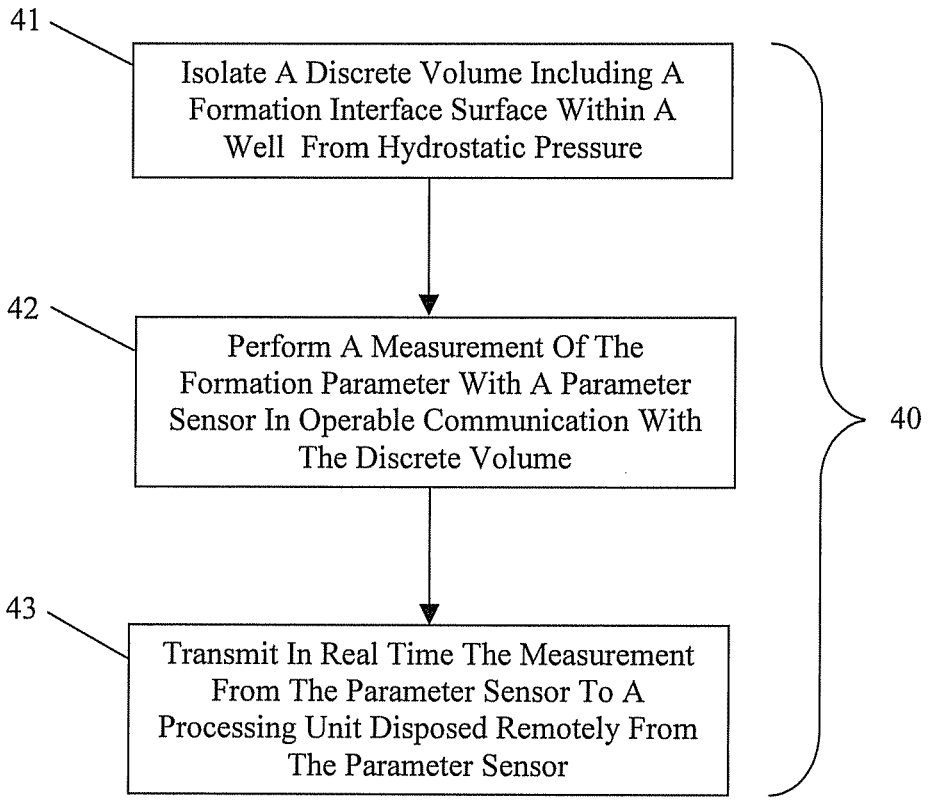
FIG. 4 presents an example of a method for measuring a pressure of a formation.

FIG. 4 presents one example of a method 40 for measuring a formation parameter. The method 40 calls for (step 41) isolating a discrete volume including a formation interface surface within a well. Further, the method 40 calls for (step 42) performing a measurement of the formation parameter with the parameter sensor 19 in operable communication with the discrete volume. Further, the method 40 calls for (step 43) transmitting in real time the measurement from the parameter sensor 19 to the processing unit 6 disposed remotely from the parameter sensor 19.

In support of the teachings herein, various analysis components may be used, including digital and/or analog systems. The digital and/or analog systems may be included in the downhole electronics unit 11 or the processing unit 6 for example. The system may have components such as a processor, analog to digital converter, digital to analog converter, storage media, memory, input, output, local communications link (such as optical, radio, inductive or acoustic), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, operator, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, motive force (such as a translational force, propulsional force, or a rotational force), digital signal processor, analog signal processor, sensor, magnet, antenna, transmitter, receiver, transceiver, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for measuring a formation parameter, the system comprising:

a formation parameter test device including:

a structure extendable from the formation parameter test device to contact a formation interface surface within a well, the structure segregating a discrete volume defined by the structure and the formation interface surface therein, and a parameter sensor in operable communication with the volume and configured to measure the formation parameter data from the discrete volume;

a high bandwidth communications system in operable communication with the parameter sensor; and a processing unit in operable communication with the high bandwidth communications system and disposed remotely from the parameter sensor at an earth surface location, the processing unit configured to receive the formation parameter data, the processing unit being configured to transmit a start signal and a stop signal from the earth surface location to the parameter sensor, wherein a travel time of the formation parameter data from the parameter sensor to the processing unit is less than a time period for completing a formation parameter test, and the processing unit being further configured to transmit a signal to the parameter sensor to alter a next formation parameter test by the parameter sensor based on data from the formation parameter test currently being conducted.

2. The system as in claim 1, wherein the parameter is pressure.

3. The system as in claim 1, wherein the device is capable of isolating hydrostatic pressure from the volume.

4. The system as in claim 1, wherein the parameter sensor is further configured to measure hydrostatic pressure in a borehole.

5. The system as in claim 1, wherein a travel time of the stop signal is less than the time period for completing the formation parameter test.

6. The system as in claim 1, further comprising a sample test device configured to receive a formation fluid from the discrete volume and for determining a property of the formation fluid.

7. The system as in claim 6, wherein the sample test device comprises another sensor to measure at least one of temperature, salinity, density, viscosity, conductivity, refractive index, clarity, and chemical composition of the formation fluid.

8. The system as in claim 1, wherein the formation parameter test device is configured to transmit a status signal to the processing unit.

9. The system as in claim 1, wherein the high bandwidth communications system comprises a broadband cable disposed at a drill string.

10. The system as in claim 9, further comprising at least one signal amplifier configured to amplify a signal on the broadband cable comprising the parameter data.

11. The system as in claim 9, further comprising an electronics unit in operable communication with the formation parameter test device to receive the data and multiplex the data for transmission to the processing unit using the broadband cable.

12. The system as in claim 1, wherein the high bandwidth communications system is adapted for transmitting data from the formation pressure test device at a rate exceeding 57,000 bits per second.

13. A method for measuring a formation parameter, the method comprising:

extending a structure from a formation parameter test device to contact a formation interface surface within a well;

isolating a discrete volume defined by the structure after it has been extended and the formation interface surface;

performing a measurement of the formation parameter within the discrete volume with a parameter sensor of the formation parameter test device in operable communication with the discrete volume; and transmitting in real time the measurement from the parameter sensor to a processing unit disposed remotely from the sensor at an earth surface location; and receiving, at the formation parameter test device from the earth surface location of the processing unit, a start signal and a stop signal to the parameter sensor for the performing the measurement, wherein a travel time for a command signal from the processing unit to the formation parameter test device is less than a time period for performing a formation parameter test and the command signal commands the parameter sensor to alter a next formation parameter test based on data from the formation parameter test currently being conducted.

14. The method as in claim 13, wherein the parameter is pressure.

15. The method as in claim 13, further comprising decreasing hydrostatic pressure within the discrete volume.

16. The method as in claim 13, further comprising performing a command with the formation parameter test device upon receiving the command signal.

17. The method as in claim 13, further comprising receiving a status signal with the processing unit from at least one of the formation parameter test device and the parameter sensor.

18. The method as in claim 13, further comprising receiving a sample of a formation fluid.

19. The method as in claim 18, further comprising performing a measurement of a property of the sample.

20. The method as in claim 19, further comprising transmitting the property measurement to the processing unit in real time.

21. The method as in claim 13, wherein the method is implemented by machine-executable instructions stored on machine-readable media.

* * * * *